US008511374B2

(12) United States Patent
Scott et al.

(10) Patent No.: US 8,511,374 B2
(45) **Date of Patent: *Aug. 20, 2013**

(54) ELECTRICALLY ACTUATED INSERT SAFETY VALVE

(75) Inventors: Bruce E. Scott, McKinney, TX (US); John J. Goiffon, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/196,573

(22) Filed: Aug. 2, 2011

(65) Prior Publication Data

US 2013/0032356 A1 Feb. 7, 2013

(51) Int. Cl.
*E21B 34/06* (2006.01)

(52) U.S. Cl.
USPC ..... 166/66.6; 166/381; 166/332.8; 166/373

(58) Field of Classification Search
USPC ..... 166/373, 381, 386, 66.6, 332.5, 332.8; 251/129.01, 129.03, 129.04; 137/512.2, 137/523, 614.19, 613
See application file for complete search history.

(56) References Cited

U.S. PATENT DOCUMENTS

| | | | |
|---|---|---|---|
| 2,703,532 | A | 3/1955 | Bobo |
| 3,196,948 | A | 7/1965 | Dye |
| 3,666,030 | A | 5/1972 | Bohn et al. |
| 3,731,742 | A | 5/1973 | Sizer et al. |
| 3,854,695 | A | 12/1974 | Baugh |
| 4,058,166 | A | 11/1977 | Crickmer |
| RE30,110 | E | 10/1979 | Huebsch et al. |
| 4,191,248 | A | 3/1980 | Huebsch et al. |
| 4,295,795 | A | 10/1981 | Gass et al. |
| 4,407,329 | A | 10/1983 | Huebsch et al. |
| 4,467,870 | A | 8/1984 | Langham |
| 4,566,534 | A | 1/1986 | Going, III |
| 4,579,177 | A | 4/1986 | Going, III |
| 4,619,323 | A | 10/1986 | Gidley |
| 4,649,993 | A | 3/1987 | Going, III |
| 4,667,736 | A | 5/1987 | Rumbaugh et al. |
| 4,725,783 | A | 2/1988 | Miyairi et al. |
| 4,732,225 | A | 3/1988 | Jurgens et al. |

(Continued)

FOREIGN PATENT DOCUMENTS

| | | | |
|---|---|---|---|
| EP | 0436214 | A1 | 7/1991 |
| GB | 2200775 | A | 8/1998 |

(Continued)

OTHER PUBLICATIONS

European Search Report issued for EP Patent Application No. 07253395 dated Nov. 15, 2007, 6 pages.

(Continued)

*Primary Examiner* — Cathleen Hutchins
(74) *Attorney, Agent, or Firm* — Smith IP Services, P.C.

(57) ABSTRACT

A method of operating an insert safety valve in a subterranean well can include installing the insert safety valve in a flow passage which extends longitudinally through an outer safety valve, making electrical contact between the insert safety valve and an electrical connector, and operating the insert safety valve, thereby selectively permitting and preventing flow through the flow passage. An insert safety valve can include a closure assembly which selectively permits and prevents flow through a longitudinal flow passage, and at least one electrical connector which electrically connects to another electrical connector external to the insert safety valve.

25 Claims, 8 Drawing Sheets

(56) References Cited

U.S. PATENT DOCUMENTS

| | | | |
|---|---|---|---|
| 4,771,982 | A | 9/1988 | Bodine et al. |
| 4,796,708 | A | 1/1989 | Lembcke |
| 4,798,247 | A | 1/1989 | Deaton et al. |
| 4,886,114 | A | 12/1989 | Perkins et al. |
| 4,940,207 | A | 7/1990 | Katsuyama |
| 4,981,173 | A | 1/1991 | Perkins et al. |
| 5,070,595 | A | 12/1991 | Perkins et al. |
| 5,070,944 | A | 12/1991 | Hopper |
| 5,257,663 | A | 11/1993 | Pringle et al. |
| 5,291,947 | A | 3/1994 | Stracke |
| 5,293,551 | A | 3/1994 | Perkins et al. |
| 5,299,640 | A | 4/1994 | Streich et al. |
| 5,310,012 | A | 5/1994 | Cendre et al. |
| 5,358,035 | A | 10/1994 | Grudzinski |
| 5,409,031 | A | 4/1995 | McGill et al. |
| 5,440,183 | A | 8/1995 | Denne |
| 5,465,786 | A | 11/1995 | Akkerman |
| 5,558,153 | A | 9/1996 | Holcombe et al. |
| 5,620,048 | A | 4/1997 | Beauquin |
| 5,734,209 | A | 3/1998 | Hallidy |
| 5,913,337 | A | 6/1999 | Williams et al. |
| 5,917,774 | A | 6/1999 | Walkow et al. |
| 6,016,845 | A | 1/2000 | Quigley et al. |
| 6,041,857 | A | 3/2000 | Carmody et al. |
| 6,112,809 | A | 9/2000 | Angle |
| 6,237,693 | B1 | 5/2001 | Deaton |
| 6,253,843 | B1 | 7/2001 | Rawson et al. |
| 6,302,210 | B1 | 10/2001 | Crow et al. |
| 6,321,845 | B1 | 11/2001 | Deaton |
| 6,352,118 | B1 | 3/2002 | Dickson et al. |
| 6,361,299 | B1 | 3/2002 | Quigley et al. |
| 6,433,991 | B1 | 8/2002 | Deaton et al. |
| 6,478,090 | B2 | 11/2002 | Deaton |
| 6,491,106 | B1 | 12/2002 | Simonds |
| 6,568,470 | B2 | 5/2003 | Goodson, Jr. et al. |
| 6,619,388 | B2 | 9/2003 | Dietz et al. |
| 6,626,244 | B2 | 9/2003 | Powers |
| 6,748,977 | B2 | 6/2004 | Berto |
| 6,988,556 | B2 | 1/2006 | Vick, Jr. |
| 7,637,326 | B2 | 12/2009 | Bolding et al. |
| 2002/0020524 | A1* | 2/2002 | Gano ..... 166/55 |
| 2002/0050361 | A1 | 5/2002 | Shaw et al. |
| 2002/0108747 | A1* | 8/2002 | Dietz et al. ..... 166/66.7 |
| 2003/0155131 | A1 | 8/2003 | Vick, Jr. |
| 2004/0159444 | A1 | 8/2004 | Wolters et al. |
| 2006/0118304 | A1 | 6/2006 | Ohmer |
| 2007/0295504 | A1* | 12/2007 | Patel ..... 166/263 |
| 2008/0047703 | A1 | 2/2008 | Stoesz et al. |
| 2010/0025045 | A1* | 2/2010 | Lake et al. ..... 166/373 |
| 2010/0044858 | A1 | 2/2010 | Cohn et al. |
| 2012/0199367 | A1 | 8/2012 | Bouldin et al. |
| 2013/0032356 | A1 | 2/2013 | Scott et al. |

FOREIGN PATENT DOCUMENTS

| | | | |
|---|---|---|---|
| GB | 2474189 | A | 4/2011 |
| JP | 11093883 | A | 4/1999 |
| WO | 2011019645 | A2 | 2/2011 |

OTHER PUBLICATIONS

Office Action issued Aug. 11, 2008 for U.S. Appl. No. 11/469,269, 17 pages.

Office Action issued Jan. 19, 2009 for U.S. Appl. No. 11/469,269, 6 pages.

Corrected Office Action issued Apr. 3, 2009 for U.S. Appl. No. 11/469,269, 6 pages.

Office Action issued Oct. 16, 2012 for U.S. Appl. No. 13/196,565, 26 pages.

Office Action issued Feb. 21, 2013 for U.S. Appl. No. 13/196,565, 15 pages.

* cited by examiner

ELECTRICALLY ACTUATED INSERT SAFETY VALVE

CROSS-REFERENCE TO RELATED APPLICATION

The present application is related to a U.S. application filed on even date herewith, entitled Safety Valve With Provisions For Powering An Insert Safety Valve, having Bruce E. Scott and John J. Goiffon as inventors, and having Ser. No. 13/196,565.

BACKGROUND

This disclosure relates generally to equipment utilized and operations performed in conjunction with a subterranean well and, in an example described below, more particularly provides an electrically actuated insert safety valve.

An insert safety valve is installed in an outer safety valve, for example, if the safety valve has ceased functioning properly (e.g., the safety valve no longer effectively seals off flow through the safety valve). The insert safety valve performs the function of the safety valve (e.g., preventing undesired discharge of fluid from a well), and saves the expense of retrieving the safety valve from the well for repair or replacement.

Therefore, it will be appreciated that improvements would be desirable in the art of constructing insert safety valves.

SUMMARY

In the disclosure below, insert safety valves and associated methods are provided which bring improvements to the art. One example is described below in which electrical power is supplied to an insert safety valve. Another example is described below in which electrical connections are made in response to installation of an insert safety valve in an outer safety valve.

In one aspect, a method of operating an insert safety valve in a subterranean well is provided to the art by the disclosure below. The method can include installing the insert safety valve in a flow passage which extends longitudinally through a safety valve, making electrical contact between the insert safety valve and an electrical connector, and operating the insert safety valve, thereby selectively permitting and preventing flow through the flow passage.

In another aspect, an insert safety valve is described below. The insert safety valve can include a closure assembly which selectively permits and prevents flow through a longitudinal flow passage, and at least one electrical connector which electrically connects to another electrical connector external to the insert safety valve.

In yet another aspect, an electrical actuator for the safety valve may be installed in the flow passage.

In a further aspect, the insert safety valve or the electrical actuator may be supplied with electrical power via a conveyance which in some examples is used to retrieve the insert safety valve or actuator from the flow passage.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
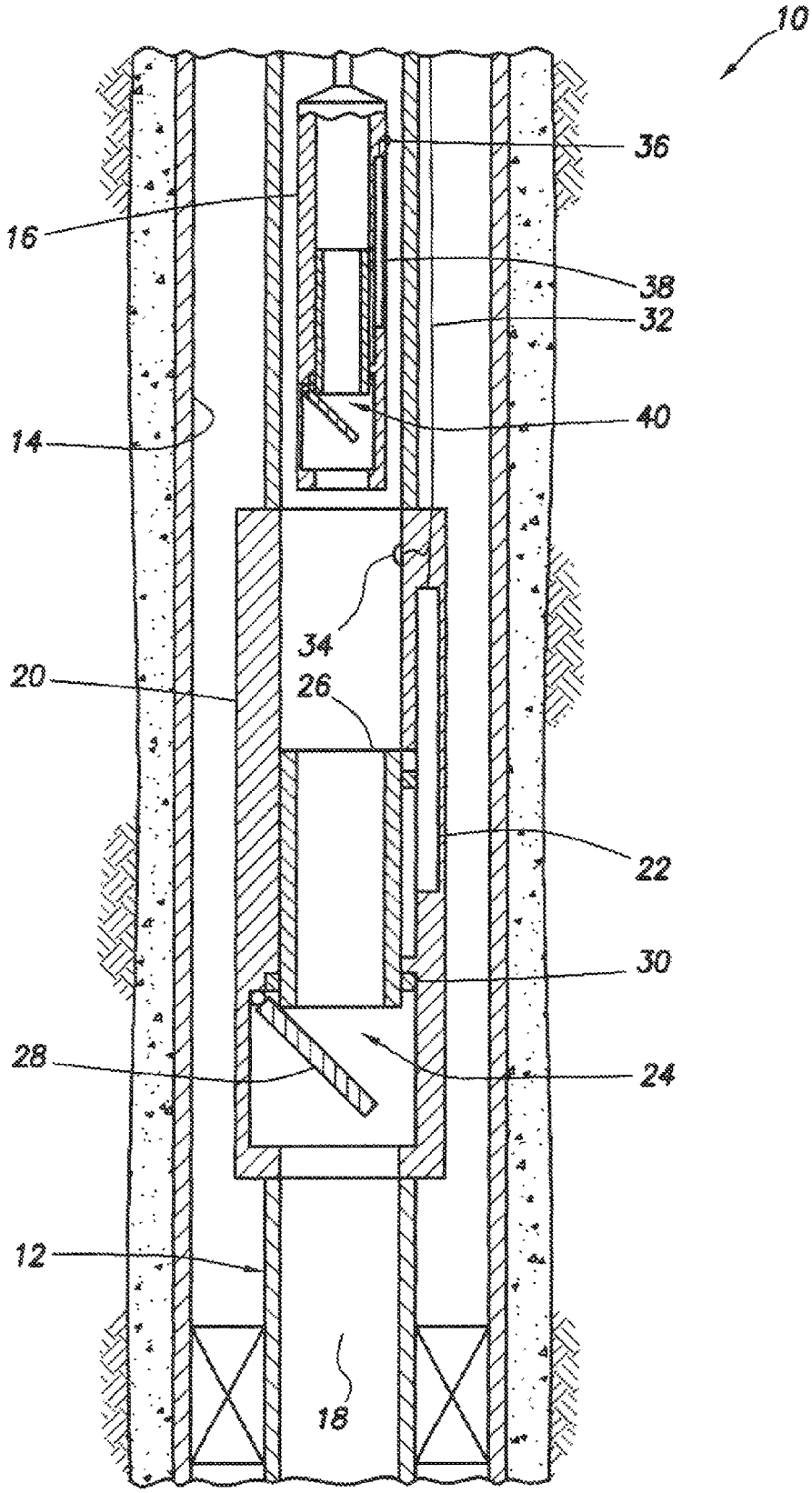
FIG. 1 is a representative partially cross-sectional view of a well system and associated method which can embody principles of this disclosure.

Representatively illustrated in FIG. 1 is a well system 10 and associated method which can embody principles of this disclosure. As depicted in FIG. 1, a tubular string 12 (such as a production tubing string, etc.) has been installed in a wellbore 14. An insert safety valve 16 is being conveyed through a flow passage 18 and into an outer safety valve 20 interconnected in the tubular string.

The insert safety valve 16 may be installed in the safety valve 20 due to, for example, malfunction of an actuator 22, loss of sealing capability in a closure assembly 24, etc. Any other reasons for installing the insert safety valve 20 may be used in keeping with the scope of this disclosure.

In the example of FIG. 1, the actuator 22 is an electrical actuator (e.g., a motorized ball screw, a linear induction motor, etc.) which displaces a flow tube or opening prong 26 to thereby pivot a flapper 28 relative to a seat 30. However, other types of actuators (such as, hydraulic actuators, etc.) and other types of closure assemblies (such as, ball-type closures, etc.) may be used in keeping with the scope of this disclosure.

Electrical power (as well as data and commands, etc.) is delivered to the safety valve 20 via lines 32 extending to a remote location (such as, the earth's surface, a subsea facility, etc.). In other examples, the lines 32 could include hydraulic lines and/or optical lines or other types of lines, instead of or in addition to electrical lines. Thus, the lines 32 could include any type, number and combination of lines in keeping with the scope of this disclosure.

In other examples, electrical power could be supplied to the safety valve 20 from downhole batteries, an electrical generator, or any other source. Thus, it is not necessary for the lines 32 to be used to supply electrical power to the safety valve 20.

In one beneficial feature of the safety valve 20, an electrical connector 34 is provided in the safety valve for making electrical contact with an electrical connector 36 of the insert safety valve 16. In this manner, the insert safety valve 16 can be electrically actuated after the insert safety valve is appropriately installed in the safety valve 20.

In other examples, the electrical connector 34 (or multiple such connectors) could be positioned in another section of the tubular string 12 (e.g., above or below the safety valve 20). The connector(s) 36 of the insert safety valve 16 could electrically contact the connectors 34 in the other section of the tubular string 12 when the insert safety valve is properly installed in the safety valve 20.

Note that the insert safety valve 16 as depicted in FIG. 1 includes an electrical actuator 38 and a closure assembly 40, similar to the actuator 22 and closure assembly 24 of the safety valve 20, but somewhat smaller dimensionally. However, it should be clearly understood that it is not necessary for the insert safety valve 16 to include an actuator or closure assembly which is similar to that of the safety valve 20. For example, the insert safety valve 16 could include a linear induction motor, whereas the safety valve 20 could include a motorized ball screw, and the insert safety valve could include a ball valve, whereas the safety valve could include a flapper valve, etc.

The insert safety valve 16 may be conveyed into the tubular string 12 by any appropriate means, such as wireline, coiled tubing, etc. The insert safety valve 16 may be of the type known to those skilled in the art as a wireline-retrievable surface controlled subsurface safety valve. The safety valve 20 may be of the type known to those skilled in the art as a tubing-retrievable surface controlled subsurface safety valve.

Note that it is not necessary for the insert safety valve 16 to be installed in, or completely within, the safety valve 20. Electrical communication can still be achieved between the safety valve 20 and the insert safety valve 16, even if the insert safety valve is installed in the flow passage 18, but is not installed completely within the safety valve.

In other examples, a separate lockout tool may be used to lock the safety valve 20 in an open configuration prior to, or during, installation of the insert safety valve 16. Alternatively, the lockout tool could be included with the insert safety valve 16, so that the safety valve 20 is locked open when the insert safety valve is installed.

Figure 2:
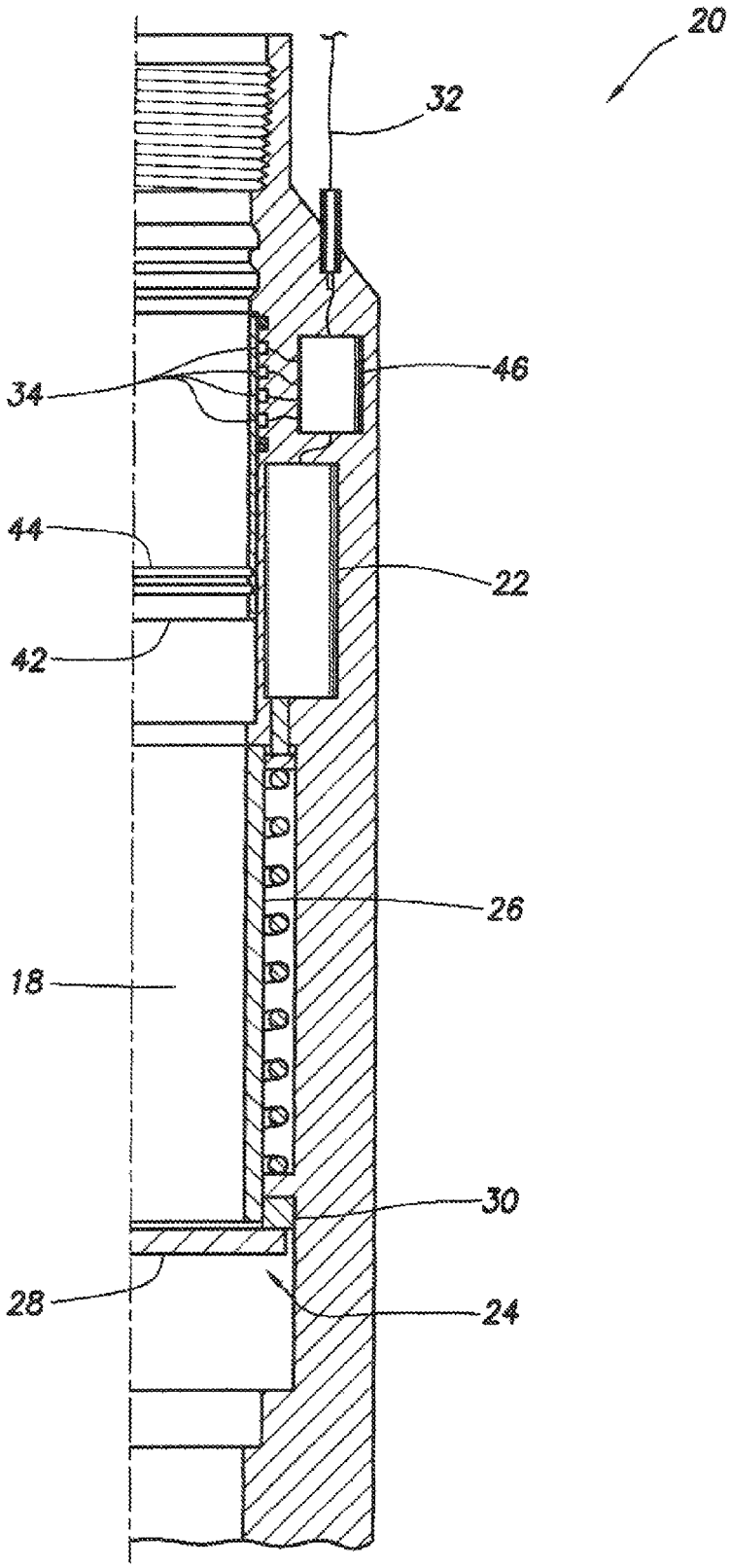
FIG. 2 is an enlarged scale representative cross-sectional view of a safety valve which may be used in the well system and method, and which can embody principles of this disclosure.

Referring additionally now to FIG. 2, an enlarged scale cross-sectional view of the safety valve 20 is representatively illustrated. The safety valve 20 of FIG. 2 may be used in the well system 10 and method described above, or the safety valve may be used in other well systems and methods, in keeping with the scope of this disclosure.

In this example, the safety valve 20 includes multiple connectors 34. The connectors 34 are isolated from fluids, debris, tools, etc. in the passage 18 by a shield 42. In other examples, only a single connector 34 may be used (e.g., if the tubular string 12 is used as a conductor, etc.).

A shifting profile 44 is provided in the shield 42 for displacing the shield and thereby exposing the connectors 34. However, other ways (e.g., see FIG. 7) of isolating and then exposing the connectors 34 may be used in keeping with the principles of this disclosure.

In the FIG. 2 example, the safety valve 20 includes electronic circuitry 46 which controls whether electrical power is delivered to the actuator 22 of the safety valve 20, or to one or more of the connectors 34 for transmission to the actuator 38 of the insert safety valve 16. For example, a signal could be transmitted via the lines 32 to the electronic circuitry 46 to switch the electrical power from the actuator 22 to the connectors 34, the electrical power could be switched in response to installation of the insert safety valve 16 in the safety valve 20, etc.

Figure 3:
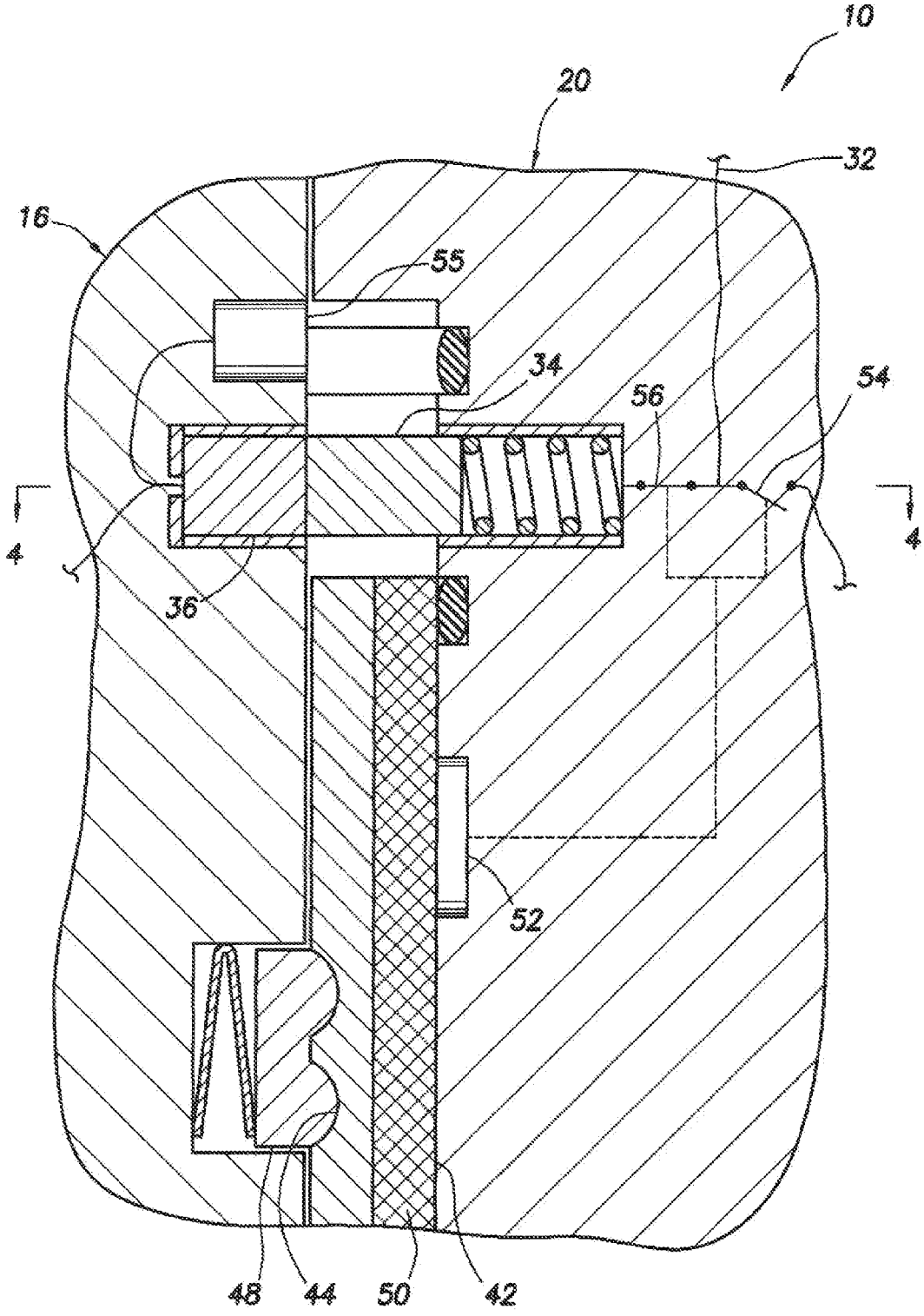
FIG. 3 is a further enlarged scale representative cross-sectional view of an electrical connection between the safety valve and an insert safety valve.

Referring additionally now to FIG. 3, an enlarged scale view of one example of an electrical connection between the insert safety valve 16 and the safety valve 20 is representatively illustrated. As depicted in FIG. 3, a shifting key 48 on the insert safety valve 16 has complementarily engaged the profile 44 in the shield 42, and has shifted the shield downward, thereby exposing the connector 34.

Note that the shield 42 may have an insulative internal coating or layer 50 on a surface which faces the connector 34. In this example, the connector 34 is biased inward, so that, when the shield 42 is displaced downward, the connector is displaced inward into electrical contact with the connector 36 of the insert safety valve 16.

A sensor 52 (such as a position sensor, linear variable displacement sensor, limit switch, etc.) may be provided to detect when the shield 42 has been displaced, and/or when the connector 34 is exposed. Switches 54, 56 can be operated in response to the sensor 52 output, to thereby disconnect electrical power from the actuator 22 of the safety valve 20 (note the open switch 54) and connect electrical power to the connector 34 (note the closed switch 56).

Alternatively, the switches 54, 56 may be operated in response to command(s) (e.g., transmitted from a local or remote location, the electronic circuitry 46, etc.), and/or in response to an electrical phenomenon (e.g., a predetermined voltage or wattage level on the lines 32, etc.).

The insert safety valve 16 may include one or more sensors 55 for measuring various well parameters (pressure, temperature, flow, etc.) and/or for detecting whether the insert safety valve has been properly installed. The sensor 55 measurements may be used for diagnostics, production data, or for any other purpose.

Data from the sensors 52, 55 may be transmitted from the insert safety valve 16 to the safety valve 20 for further transmission (e.g., via wired or wireless telemetry, etc.) to a remote receiving device (e.g., at the earth's surface, a remote recording device, etc.).

Figure 4:
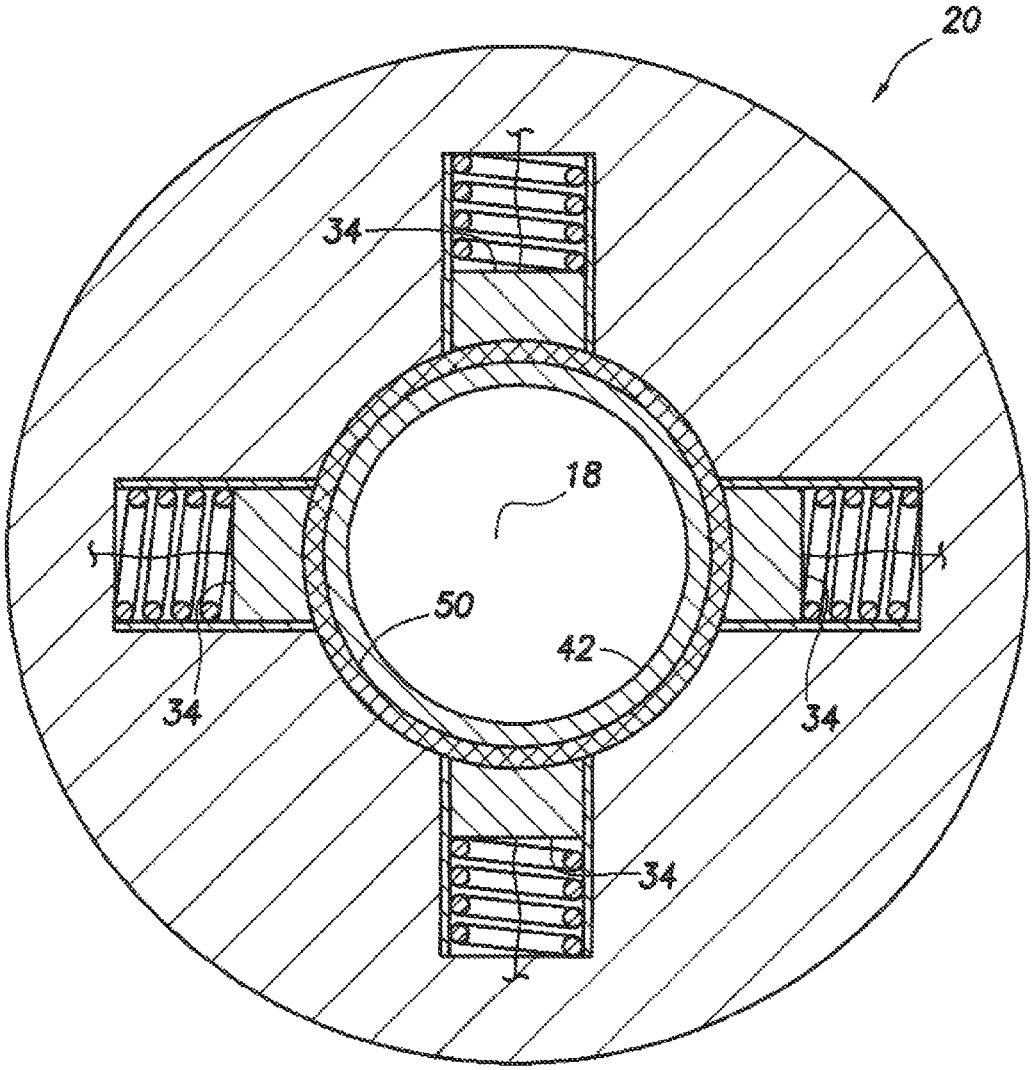
FIG. 4 is a cross-sectional view of the safety valve, taken along line 4-4 of FIG. 3.

Referring additionally now to FIG. 4, a cross-sectional view of the safety valve 20 is representatively illustrated. In this view, it may be seen that the safety valve 20 can include multiple connectors 34 circumferentially spaced apart about the flow passage 18. As described more fully below (see FIG. 6), an alignment device may be used to rotationally align the insert safety valve 16 with the connectors 34.

Figure 5:
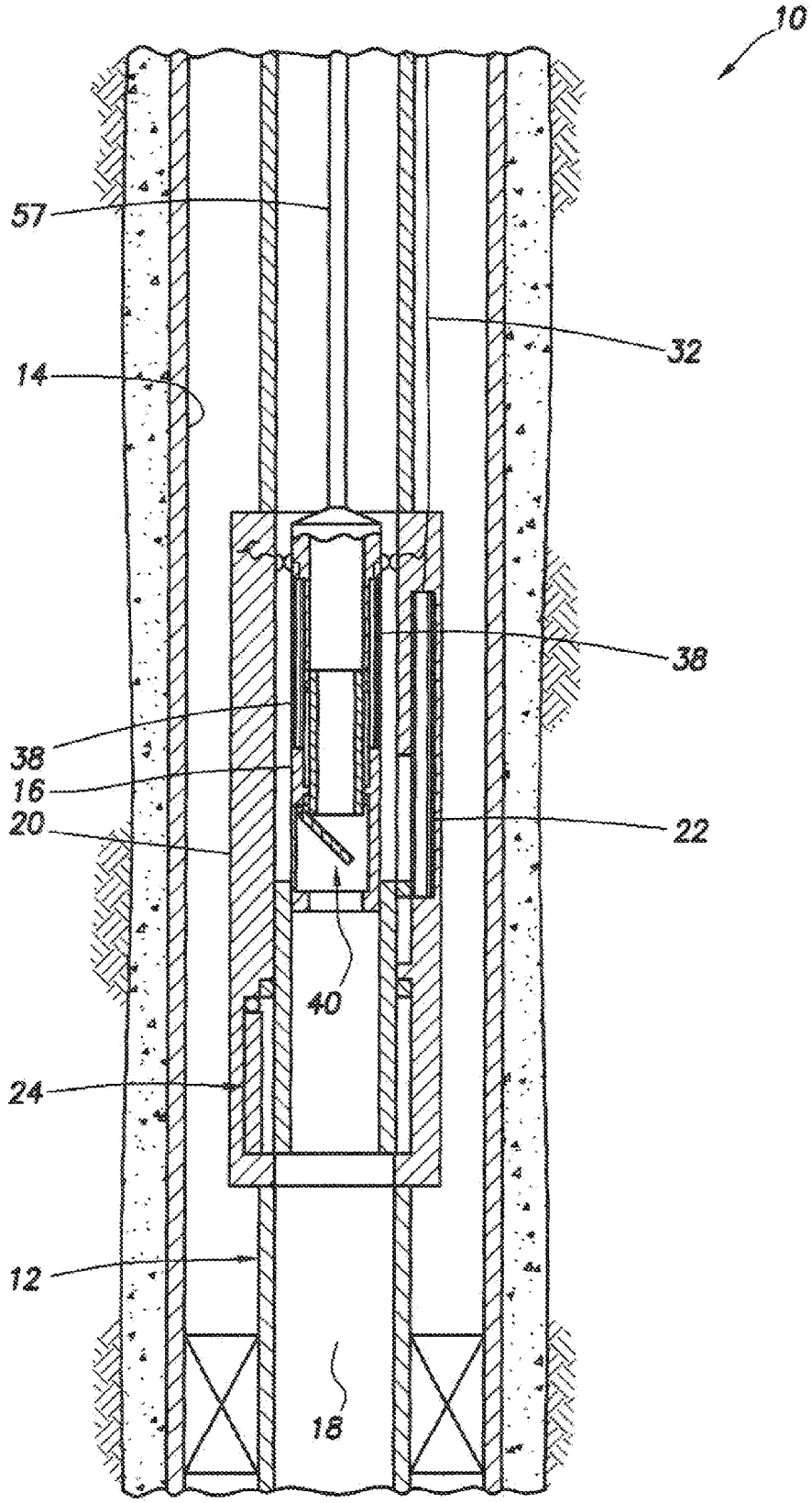
FIG. 5 is a representative cross-sectional view of the well system, wherein another configuration of the insert safety valve has been installed in the safety valve.

Referring additionally now to FIG. 5, another configuration of the well system 10 is representatively illustrated. In this configuration, the insert safety valve 16 has been installed in the safety valve 20, an electrical connection has been made between the safety valve 20 and the insert safety valve 16 for electrical operation of the insert safety valve.

In addition, in the example of FIG. 5, multiple actuators 38 may be used in the insert safety valve 16 for operating the closure assembly 40 to selectively permit and prevent flow through the passage 18. A conveyance 57 (such as, wireline, coiled tubing, etc.) used to convey the insert safety valve 16 into the passage 18 can now be retrieved from the well.

Figure 6:
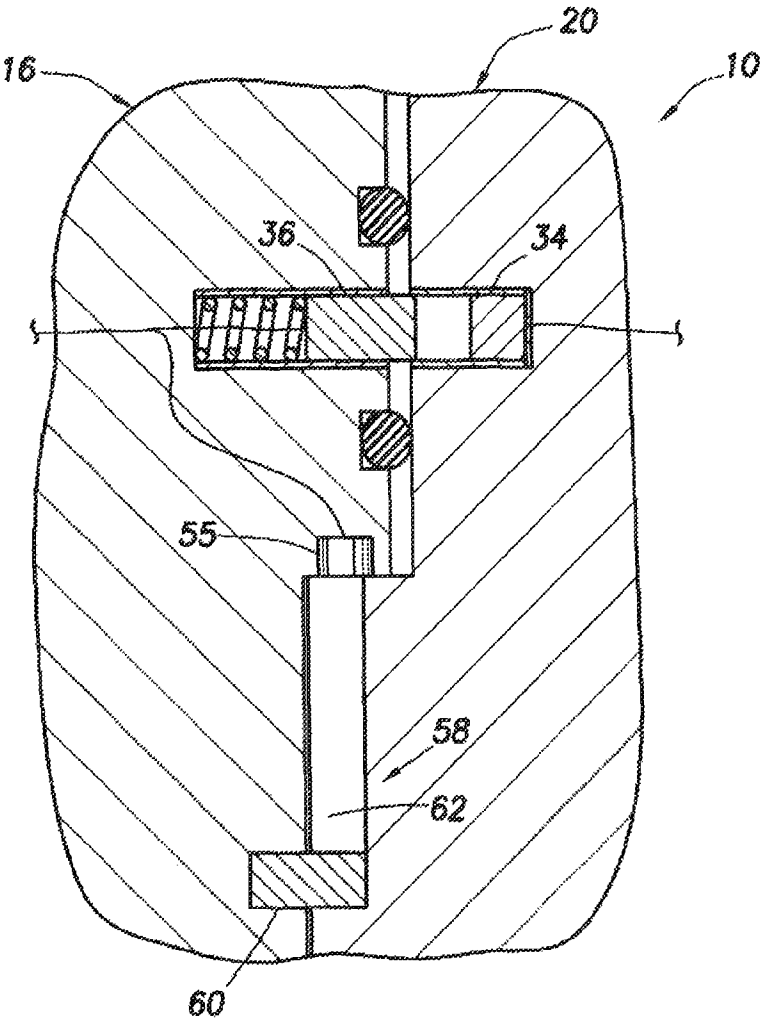
FIG. 6 is an enlarged scale representative cross-sectional view of another configuration of the electrical connection and aligned engagement between the safety valve and the insert safety valve.

Referring additionally now to FIG. 6, another configuration of an electrical connection between the insert safety valve 16 and the safety valve 20 is representatively illustrated. In this configuration, an alignment device 58 is used to rotationally align the insert safety valve 16 with the safety valve 20, so that appropriate pairs of the connectors 34, 36 are aligned with each other.

In the FIG. 6 example, an alignment lug 60 carried on the insert safety valve 16 engages an alignment profile 62 formed in the safety valve 20. The sensor 54 detects when the lug 60 has fully engaged the profile 62, and the connectors 34, 36 are properly aligned.

As depicted in FIG. 6, the connector 34 is positioned in a recess, and the connector 36 is biased outward into electrical contact with the connector 34. However, it should be clearly understood that any types of connectors (such as wet connects, etc.), and any manner of making electrical contact between the connectors, may be used in keeping with the scope of this disclosure.

Figure 7:
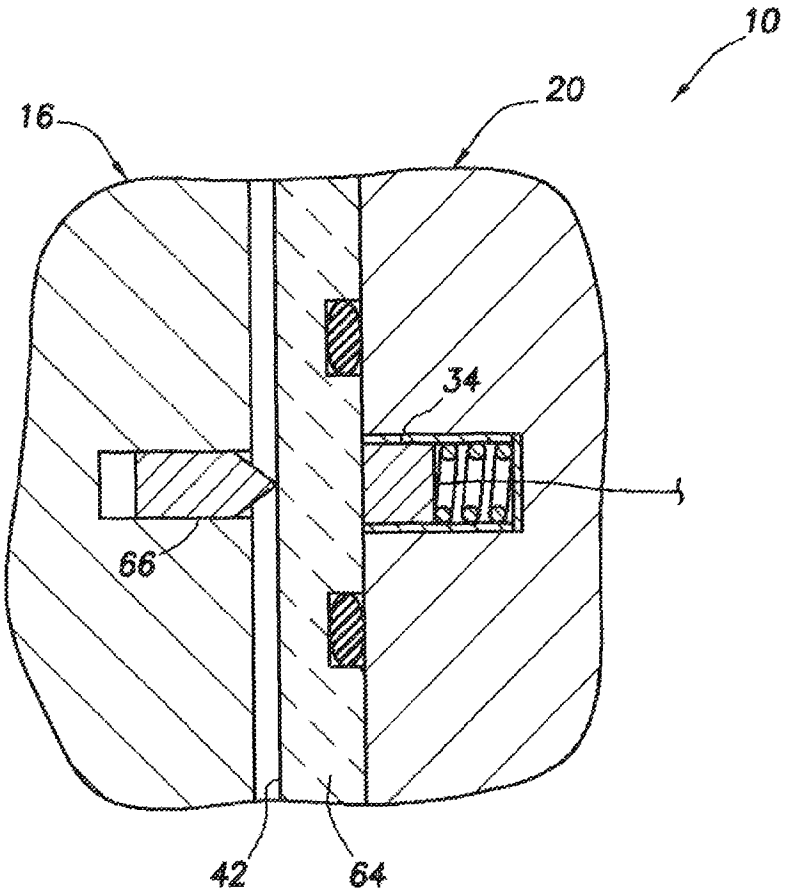
FIG. 7 is a representative cross-sectional view of a frangible shield used to protect an electrical connection in the safety valve.

Referring additionally now to FIG. 7, another method of exposing the connector 34 is representatively illustrated. In this method, the shield 42 is made of a frangible material 64 (such as, glass, ceramic, etc.), which is broken, thereby exposing the connector 34, when the insert safety valve 16 is installed.

For example, the insert safety valve 16 could include an impact tool 66 which breaks the shield 42. Alternatively, the safety valve 20 could include the tool 16 or other device which breaks the shield 42.

Preferably, the shield 42 in this example is broken in response to appropriate installation of the insert safety valve 16 in the passage 18, but other ways of breaking the shield may be used in keeping with the scope of this disclosure.

Figure 8:
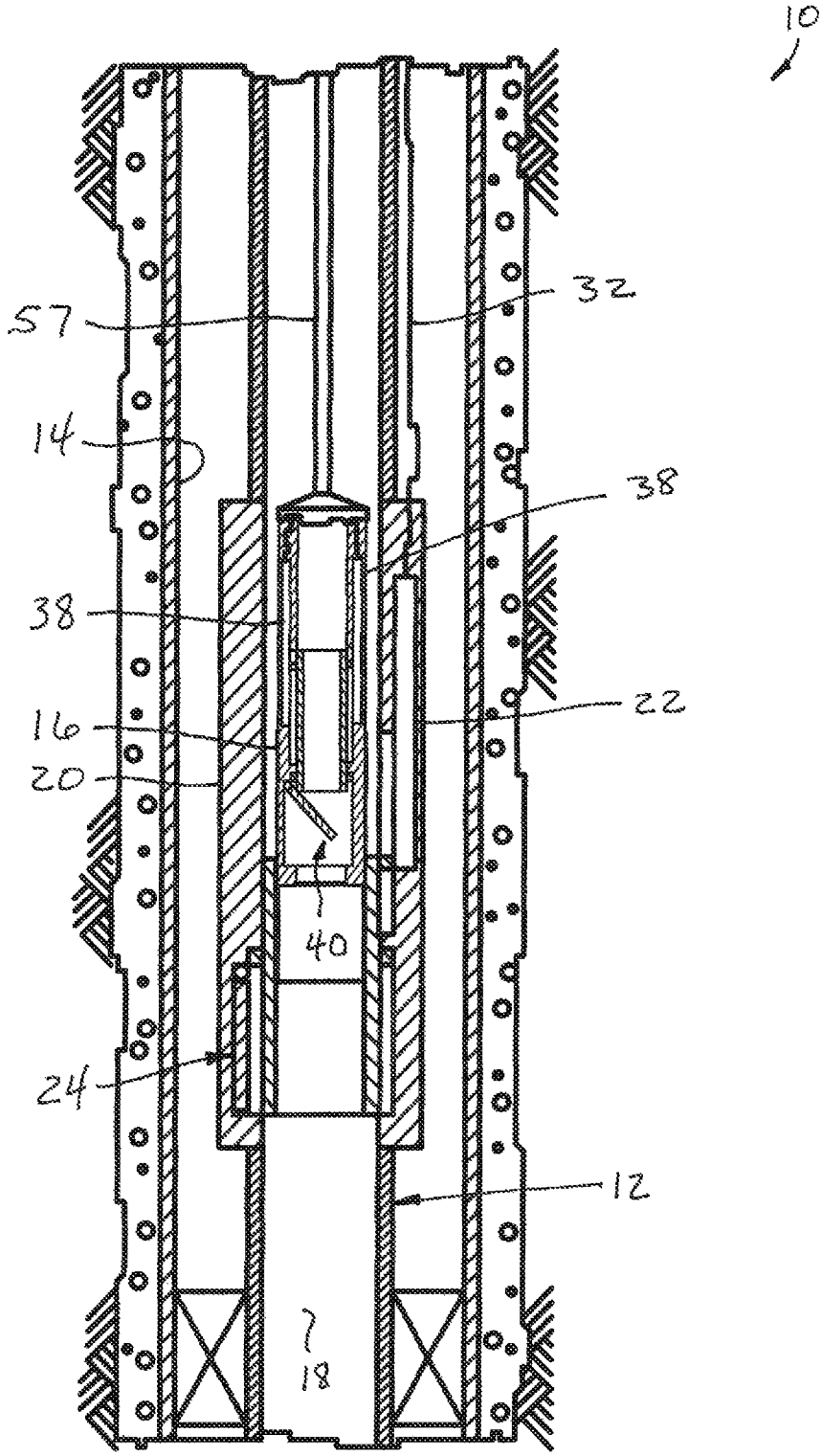
FIG. 8 is a representative cross-sectional view of the well system, wherein another configuration of the insert safety valve has been installed in the safety valve.

Referring additionally now to FIG. 8, another configuration of the insert safety valve 16 is representatively illustrated in the well system 10. This configuration is similar to that depicted in FIG. 5, but differs in at least one significant respect, in that the FIG. 8 configuration does not include the electrical connectors 34, 36.

Instead, the insert safety valve 16 (and/or the one or more actuators 38 thereof) are supplied with electrical power via the conveyance 57. For example, the conveyance 57 could comprise a wireline cable with electrical conductors therein. Thus, it will be appreciated that any way of supplying electrical power to the insert safety valve 16 and/or the actuator(s) 38 may be used, in keeping with the scope of this disclosure.

One advantage of using the conveyance 57 to supply electrical power to the insert safety valve 16 is that the conveyance may then be used to conveniently retrieve the insert safety valve from the well, if desired (for example, to replace or repair the insert safety valve). However, it is not necessary for the same conveyance 57 used to install the insert safety valve 16 and/or the actuator(s) 38, to also be used for retrieving the insert safety valve and/or actuator(s). Similarly, it is not necessary for the same conveyance 57 used to install the insert safety valve 16 and/or actuator(s) 38, to be used for supplying electrical power to the insert safety valve and/or actuator(s).

Figure 9:
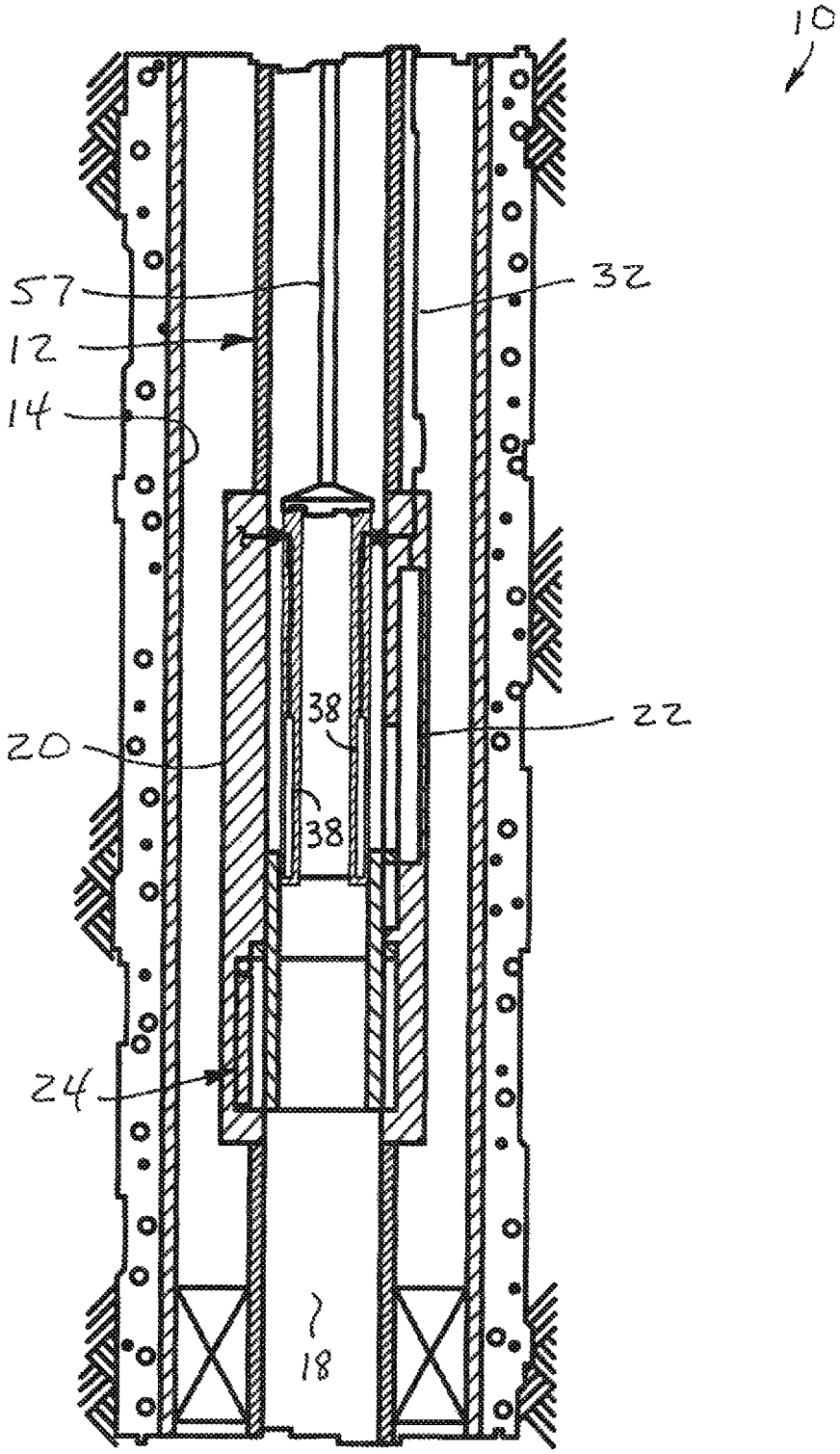
FIG. 9 is a representative cross-sectional view of the well system, wherein an actuator is installed in the safety valve.

Referring additionally now to FIG. 9, another configuration is representatively illustrated. In this configuration, the one or more actuator(s) 38 are installed using the conveyance 57, but the closure assembly 40 is not installed.

Instead, the actuator(s) 38 are used to operate the closure assembly 24 of the safety valve 20. Thus, the insert safety valve 16 is not installed in the safety valve 20, but the actuator (s) 38 are installed and used to operate the closure assembly 24 (and not the closure assembly 40).

Electrical power may be supplied to the actuator(s) 38 via the connectors 34, 36 (e.g., as in the FIG. 5 configuration), via the conveyance 57 (e.g., as in the FIG. 8 configuration), or by any other suitable means. Electrical power may be supplied to the actuator(s) 38 in response to proper installation of the actuator(s) in the safety valve 20. For example, the electrical connectors 34, 36 could make electrical contact in response to proper positioning of the actuator(s) 38 in the safety valve 20 (e.g., as described above for the insert safety valve 16).

The actuator(s) 38 may be installed in the safety valve 20 as a replacement for the actuator 22, and/or as a supplement to the actuator 22. In one example, disconnecting the actuator 22 from electrical power and connecting the actuator(s) 38 to electrical power (e.g., as in the FIG. 3 configuration) could be used to initiate operation of the closure assembly 24 by the actuator(s) 38.

It may now be fully appreciated that this disclosure provides several advancements to the art. In examples described above, the insert safety valve 16 is conveniently and positively supplied with electrical power to open or close the insert safety valve, upon installation of the insert safety valve in the safety valve 20 or flow passage 18.

The above disclosure describes an outer safety valve 20. The safety valve 20 can include a closure assembly 24 which selectively permits and prevents flow through a longitudinal flow passage 18, and at least one electrical connector 34 which electrically connects to an insert safety valve 16 positioned in the flow passage 18.

Electrical current flow between the electrical connector 34 and the insert safety valve 16 may cause the insert safety valve 16 to operate. Electrical current flow between the electrical connector 34 and the insert safety valve 16 may cause the insert safety valve 16 to open.

Electrical current flow between the electrical connector 34 and the insert safety valve 16 may cause multiple electrical actuators 38 of the insert safety valve 16 to operate.

The safety valve 20 may include a shield 42 which isolates the electrical connector 34 from the insert safety valve 16. The electrical connector 34 can be exposed to the insert safety valve 16 in response to installation of the insert safety valve 16 in the flow passage 18.

Electrical power may be delivered to the insert safety valve 16 in response to installation of the insert safety valve 16 in the flow passage 18. Electrical power may be delivered to the insert safety valve 16 in response to the electrical connector 34 being exposed to the flow passage 18.

The safety valve 20 may include an alignment profile 62 which rotationally aligns the insert safety valve 16 with the electrical connector 34.

The safety valve 20 may include an electrical actuator 22 which operates the closure assembly 24.

Electrical power may be disconnected from the electrical actuator 22 in response to installation of the insert safety valve 16 in the flow passage 18. Electrical power may be connected to the insert safety valve 16 in response to installation of the insert safety valve 16 in the flow passage 18.

Also described above is a method of operating an outer safety valve 20 in a well. The method can include installing an insert safety valve 16 in the safety valve 20, and operating the insert safety valve 16 with electrical current flowing from the safety valve 20 to the insert safety valve 16.

The installing step can include making electrical contact between the safety valve 20 and the insert safety valve 16. Making electrical contact may include connecting electrical connectors 34, 36 of the safety valve 20 and the insert safety valve 16. Making electrical contact may include exposing at least one of the electrical connectors 34, 36.

The exposing step may include displacing a shield 42, or breaking a frangible shield 42.

The exposing step may be performed in response to installation of the insert safety valve 16 in a flow passage 18 which extends longitudinally through the safety valve 20.

The safety valve 20 may include an electrical actuator 22 which operates a closure assembly 24. The method can include disconnecting the electrical actuator 22 from electrical power in response to installing the insert safety valve 16 in the safety valve 20.

The installing step can include rotationally aligning an electrical connector 36 of the insert safety valve 16 with an electrical connector 34 of the safety valve 20.

Operating the insert safety valve 16 can include operating the insert safety valve 16 from a closed configuration to an open configuration in response to the electrical current flowing from the safety valve 20 to the insert safety valve 16.

Operating the insert safety valve 16 may include operating multiple electrical actuators 38 of the insert safety valve 16.

In some examples described above, a method of operating an insert safety valve 16 in a subterranean well can include installing the insert safety valve 16 in a flow passage 18 which extends longitudinally through an outer safety valve 20, making electrical contact between at least one first electrical connector 36 of the insert safety valve 16 and at least one second electrical connector 34, and operating the insert safety valve 16, thereby selectively permitting and preventing flow through the flow passage 18.

The second electrical connector 34 may be disposed in the safety valve 20. The step of making electrical contact may be performed in response to installing the insert safety valve 16.

The step of making electrical contact can include exposing at least one of the electrical connectors 34, 36. The exposing step can comprise displacing or breaking a shield 42. The exposing step may be performed in response to installing the insert safety valve 16.

The insert safety valve 16 may comprise an electrical actuator 38 which operates a closure assembly 40. The method may include connecting the electrical actuator 38 to electrical power in response to installing the insert safety valve 16 in the safety valve 20.

The installing step can include rotationally aligning the first electrical connector 36 with the second electrical connector 34.

Operating the insert safety valve 16 can include operating the insert safety valve 16 from a closed configuration to an open configuration in response to electrical current flowing between the second electrical connector 34 and the insert safety valve 16.

Operating the insert safety valve 16 may include operating multiple electrical actuators 38 of the insert safety valve 16.

In some examples described above, an insert safety valve 16 can include a closure assembly 40 which selectively permits and prevents flow through a longitudinal flow passage 18, and at least one first electrical connector 36 which electrically connects to at least one second electrical connector 34 external to the insert safety valve 16.

Electrical current flow between the second electrical connector 34 and the insert safety valve 16 may cause the insert safety valve 16 to operate.

Electrical current flow between the second electrical connector 34 and the insert safety valve 16 may cause the insert safety valve 16 to open.

Electrical current flow between the second electrical connector 34 and the insert safety valve 16 may cause multiple electrical actuators 38 of the insert safety valve 16 to operate.

The safety valve 20 may include a shield 42 which isolates the second electrical connector 34 from the insert safety valve 16. The second electrical connector 34 may be exposed to the insert safety valve 16 in response to installation of the insert safety valve 16 in the flow passage 18.

Electrical power may be delivered to the insert safety valve 16 in response to installation of the insert safety valve 16 in the flow passage 18.

Electrical power may be delivered to the insert safety valve 16 in response to the second electrical connector 34 being exposed to the flow passage 18.

The insert safety valve 16 may include an alignment device 58 which rotationally aligns the first and second electrical connectors 34, 36.

The insert safety valve 16 may include an electrical actuator 38 which operates the closure assembly 40.

Electrical power may be connected to the electrical actuator 38 in response to installation of the insert safety valve 16 in the flow passage 18.

Electrical power may be connected to the insert safety valve 16 in response to installation of the insert safety valve 16 in the flow passage 18.

The insert safety valve 16 may include a sensor 55 which measures a well parameter.

The insert safety valve 16 may include a sensor 52 which detects an operating parameter of the insert safety valve 16.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

In the above description of the representative examples, directional terms (such as "above," "below," "upper," "lower," etc.) are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore, whether the wellbore is horizontal, vertical, inclined, deviated, etc. However, it should be clearly understood that the scope of this disclosure is not limited to any particular directions described herein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of this disclosure. Accordingly, the foregoing detailed description is to be clearly understood as being given by way of illustration and example only, the spirit and scope of the invention being limited solely by the appended claims and their equivalents.

What is claimed is:

1. A method of operating an insert safety valve in a subterranean well, the method comprising:

installing the insert safety valve in a flow passage which extends longitudinally through an outer safety valve;

making electrical contact between at least one first electrical connector of the insert safety valve and at least one second electrical connector; and operating the insert safety valve, thereby selectively permitting and preventing flow through the flow passage.

2. The method of claim 1, wherein the at least one second electrical connector is disposed in the outer safety valve.

3. The method of claim 1, wherein making electrical contact is performed in response to installing the insert safety valve.

4. The method of claim 1, wherein making electrical contact further comprises exposing at least one of the first and second electrical connectors.

5. The method of claim 4, wherein exposing comprises displacing a shield.

6. The method of claim 4, wherein exposing comprises breaking a frangible shield.

7. The method of claim 4, wherein exposing is performed in response to installing the insert safety valve.

8. The method of claim 1, wherein the insert safety valve comprises an electrical actuator which operates a closure assembly.

9. The method of claim 8, further comprising connecting the electrical actuator to electrical power in response to installing the insert safety valve in the outer safety valve.

10. The method of claim 1, wherein installing further comprises rotationally aligning the first electrical connector with the second electrical connector.

11. The method of claim 1, wherein operating the insert safety valve further comprises operating the insert safety valve from a closed configuration to an open configuration in response to electrical current flowing between the second electrical connector and the insert safety valve.

12. The method of claim 1, wherein operating the insert safety valve further comprises operating multiple electrical actuators of the insert safety valve.

13. An insert safety valve, comprising:

a closure assembly which selectively permits and prevents flow through a longitudinal flow passage; and at least one first electrical connector which makes direct electrical contact with at least one second electrical connector of an outer safety valve when the insert safety valve is positioned in the outer safety valve.

14. The insert safety valve of claim 13, wherein electrical current flow between the second electrical connector and the insert safety valve causes the insert safety valve to operate.

15. The insert safety valve of claim 13, wherein electrical current flow between the second electrical connector and the insert safety valve causes the insert safety valve to open.

16. The insert safety valve of claim 13, wherein electrical current flow between the second electrical connector and the insert safety valve causes multiple electrical actuators of the insert safety valve to operate.

17. The insert safety valve of claim 13, wherein the outer safety valve includes a shield which isolates the second electrical connector from the insert safety valve, and wherein the second electrical connector is exposed to the insert safety valve in response to installation of the insert safety valve in the flow passage.

18. The insert safety valve of claim 13, wherein electrical power is delivered to the insert safety valve in response to installation of the insert safety valve in the flow passage.

19. The insert safety valve of claim 13, wherein electrical power is delivered to the insert safety valve in response to the second electrical connector being exposed to the flow passage.

20. The insert safety valve of claim 13, further comprising an alignment device which rotationally aligns the first and second electrical connectors.

21. The insert safety valve of claim 13, further comprising an electrical actuator which operates the closure assembly.

22. The insert safety valve of claim 21, wherein electrical power is connected to the electrical actuator in response to installation of the insert safety valve in the flow passage.

23. The insert safety valve of claim 22, wherein the electrical power is connected to the insert safety valve in response to installation of the insert safety valve in the flow passage.

24. The insert safety valve of claim 13, further comprising a sensor which measures a well parameter.

25. The insert safety valve of claim 13, further comprising a sensor which detects an operating parameter of the insert safety valve.

* * * * *